US006415701B1

(12) United States Patent
Dobbins

(10) Patent No.: US 6,415,701 B1
(45) **Date of Patent: *Jul. 9, 2002**

(54) FORWARD MOUNTED BREECH LOCKING MECHANISM

(75) Inventor: David Dobbins, North Augusta, SC (US)

(73) Assignee: Hesco Incorporated, LaGrange, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/480,653

(22) Filed: Jan. 11, 2000

Related U.S. Application Data

(62) Division of application No. 09/012,986, filed on Jan. 26, 1998, now Pat. No. 6,135,005.

(51) Int. Cl.[7] ..... F41A 9/35
(52) U.S. Cl. ..... 89/1.41; 89/126; 89/188
(58) Field of Search ..... 89/172, 174, 176, 89/185, 188, 190, 126, 127, 1.41

(56) References Cited

U.S. PATENT DOCUMENTS

| | | | | | |
|---|---|---|---|---|---|
| 993,175 | A | | 5/1911 | Knotgen | 89/126 |
| 1,395,460 | A | | 11/1921 | Thompson | 89/126 |
| 1,839,621 | A | | 1/1932 | Umberto | 89/126 |
| 2,353,601 | A | | 7/1944 | Tisdale, Sr. | 89/126 |
| 2,926,568 | A | | 3/1960 | Neder | 89/126 |
| 2,941,449 | A | * | 6/1960 | Reed | 89/185 |
| 3,720,133 | A | | 3/1973 | Jampy et al. | 89/126 |
| 3,866,516 | A | * | 2/1975 | Frisoli | 89/190 |
| 4,389,920 | A | * | 6/1983 | Dufour, Sr. | 89/190 |
| 4,492,050 | A | * | 1/1985 | Kagehiro | 42/1.06 |
| 4,679,486 | A | | 7/1987 | Landaas | 89/126 |
| 4,867,039 | A | * | 9/1989 | Dobbins | 89/127 |
| 4,882,973 | A | | 11/1989 | Piscetta | 89/1.41 |
| 5,440,963 | A | | 8/1995 | Szecsei | 89/20.2 |
| 5,447,092 | A | | 9/1995 | Dobbins | 42/16 |
| 5,524,374 | A | * | 6/1996 | Gernstein | 42/1.06 |
| 6,135,005 | A | * | 10/2000 | Dobbins | 89/127 |

FOREIGN PATENT DOCUMENTS

| | | | | |
|---|---|---|---|---|
| DE | 3109730 | * | 11/1982 | 89/190 |
| DE | 3248453 | * | 7/1984 | 89/190 |
| FR | 828259 | * | 5/1938 | 89/176 |
| GB | 20773 | * | 9/1903 | 89/176 |
| GB | 18363 | * | 2/1910 | 89/190 |

* cited by examiner

*Primary Examiner*—Stephen M. Johnson
(74) *Attorney, Agent, or Firm*—Birch, Stewart, Kolasch & Birch, LLP

(57) ABSTRACT

A two-barrel gun for firing two types of ammunition includes a single breech locking mechanism for both barrels. The gun includes a selector lever for activating one of two bolts associated with the two barrels, and a single trigger for firing ammunition from a chamber associated with the activated bolt. The gun further includes two magazines for feeding ammunition to the chambers, and a pump-action forearm for ejecting spent ammunition and for loading a new round of ammunition into the chamber associated with the activated bolt. The single breech locking mechanism extends forwardly of the chambers, and the actual breech locking engagement occurs in front of the bolts. Therefore, the receiver section of the gun can be made more compact, and can more easily accommodate other essential components.

18 Claims, 10 Drawing Sheets

FORWARD MOUNTED BREECH LOCKING MECHANISM

This application is a divisional of application Ser. No. 09/012,986, filed on Jan. 26, 1998, the entire contents of which are hereby incorporated by reference now U.S. Pat. No. 6,135,005.

BACKGROUND OF THE INVENTION

1. Field of the Invention

The present invention relates to a multiple-barrel, repeating firearm. The firearm includes multiple bolts, equal in number to the number of multiple barrels, and includes a single lock-up mechanism capable of locking each of the bolts.

2. Description of the Background Art

Various repeating firearms are known in the prior art. Further, a firearm having two barrels and being capable of selectively firing two different types of ammunition is known, from my prior U.S. Pat. Nos. 4,867,039 4,867,039 details a firearm with the capability of firing either shotgun shells or rifle cartridges in response to a positioning of a selector lever. Incorporation by reference is made to the disclosure of this patent for the purposes of explaining the structure and functioning of various firearm components, not improved by the present invention.

Multiple-barrel firearms, as well as single-barrel firearms, include a breech locking mechanism. The breech locking mechanism closes the breech of the barrel by securing a bolt against a chamber formed at the end of the barrel. In typical operation, a round of ammunition is fed, either manually or mechanically, into the chamber at the end of a gun barrel. Next, the bolt is moved to a position adjacent the chamber. The bolt contains a firing pin, which is aligned with a primer of the loaded ammunition. The bolt is locked by some type of breech locking mechanism, so that upon firing of the ammunition the bolt will be blocked against any rearward movement.

To fire the weapon, the firing pin is stuck by a hammer, or released from a spring tension, thereby firing, the round of ammunition. After the ammunition is fired, the bolt is unlock and moved to a position remote from the chamber, so that the spent cartridge may be removed from the chamber, either manually or mechanically. At this point, the firing cycle is completed, and a new round of ammunition may be inserted into the chamber to begin a new firing cycle.

Several types of breech locking mechanisms are known in the background art. For example, U.S. Pat. No. 4,867,039 illustrates two independent, ball-lockup type breech locking mechanisms. An upper breech locking mechanism operates in conjunction with the upper bolt for firing shotgun shells, and a lower breech locking mechanism operates in conjunction with the lower bolt for firing rifle cartridges.

FIGS. 10 and 11 illustrate the upper breech locking mechanism of U.S. Pat. No. 4,867,039, wherein a bolt 100 is seated to a chamber 101. A circular locking groove 102 is provided rearwardly of the chamber 101. The bolt 100 includes a plurality of balls 103. A breech locking mechanism 104 includes a forward curved end 105, which is brought to bear against inner portions of the balls 103. The balls 103 are pressed outwardly, into the groove 102, thereby locking the bolt 100 against any rearward movement.

After the ammunition round is fired, the breech locking mechanism 104 is moved rearwardly. The forward curved end 105 moves away from its engagement with the balls 103 of the bolt 100, thereby freeing the bolt 100 to move in the rearward direction. It should be noted that the components of the breech locking mechanism 104 are located rearwardly of the chamber 101. Furthermore, the actual locking of the breech, i.e. the balls 103 engaging into the groove 102, occurs rearwardly of the chamber 101 and forward face of the bolt 100.

U.S. Pat. No. 5,440,963 illustrates another well-known type of breech locking mechanism. FIG. 12 illustrates the breech locking mechanism wherein three locking lugs 200 are attached to a rear portion of a bolt 201. The bolt 201 is rotated so as to insert the three locking lugs 200 into three locking grooves 202 located in the receiver section 203. The engagement between the locking lugs 200 and the locking grooves 202 assures that the bolt 201 will not move rearwardly during firing of a round of ammunition.

After firing, the bolt 201 is rotated to free the locking lugs 200 from the locking grooves 202, so that the bolt 201 may be manually moved rearwardly for cartridge extraction and ammunition reloading. Again, it should be noted that the components of the breech locking mechanism are located rearwardly of the chamber, and therefore the actual locking, i.e. locking lugs 200 engaged into locking grooves 202, occurs rearwardly of the chamber and the forward face of the bolt 201.

All known breech locking mechanisms include a locking engagement which occurs rearwardly of the chamber and the forward face of the bolt. Such known breech locking mechanisms take up space inside the receiver section of the firearm. The space inside the receiver section houses essential components of the firearm, such as the trigger assembly, safety, and ejection and feeding mechanisms. Moreover, in a multi-barrel firearm, as in the present invention, the receiver section space also accommodates a selector mechanism for choosing which bolt will be fired, as well as an additional set of extraction and feeding mechanisms. Therefore, the presence of the reach locking mechanism inside the receiver section complicates the design of the receiver section and/or requires that the receiver section have an enlarged volume.

Consequentially, there exists a need in the art for a breech locking mechanism, which requires a minimum amount of space inside the receiver section of the firearm.

SUMMARY OF THE INVENTION

Accordingly, it is a primary object of the present invention to provide a multiple-barrel, repeating firearm which locates most of the breech locking components forward of the chambers and forward faces of the bolts.

It is another object of the present invention to provide a multiple-barrel, repeating firearm having a breech locking mechanism wherein the actual locking of the breech occurs forward of the chambers and the forward faces of the bolts.

Yet another object of the present invention is to provide a multiple-barrel, repeating firearm utilizing a single and shared breech locking mechanism for the bolts of the multiple barrels.

These and other objects of the present invention are fulfilled by providing a firearm comprising: a first barrel having a first end and a second end; a second barrel having a first end and a second end; a first chamber located at said first end of said first barrel; a second chamber located at said first end of said second barrel; a first bolt having a forward face for abutting said first chamber of said first barrel; a second bolt having a forward face for abutting said second chamber of said second barrel; and a breech locking mechanism for locking said first and second bolts into abutment with said first and second chambers, respectively, wherein said breech locking mechanism includes locking components located between said forward faces of said first and second bolts and said second ends of said first and second barrels.

These and other objects of the present invention are also fulfilled by providing a firearm comprising: a first barrel having a first end and a second end; a first chamber located at said first end of said first barrel; a first bolt for abutting said first end of said first barrel; and a breech locking mechanism for locking said first bolt into abutment with said first end of said first barrel, wherein said breech locking mechanism includes locking components located between said first end of said first barrel and said second end of said first barrel.

Furthermore, these and other objects of the present invention are fulfilled by providing a firearm comprising: a first barrel having a first end and a second end; a second barrel having a first end and a second end; a first chamber located at said first end of said first barrel; a second chamber located at said first end of said second barrel; a first bolt having a forward face for abutting said first chamber of said first barrel; a second bolt having a forward face for abutting said second chamber of said second barrel; a breech locking mechanism for locking said first and second bolts into abutment with said first and second chambers, respectively; a magazine for feeding ammunition to said first chamber; and a feed path connecting said magazine and said first chamber, wherein a centerline of said second barrel passes through said feed path.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus, are not limitative of the present invention, and wherein.

DETAILED DESCRIPTION OF THE INVENTION

Figure 1:
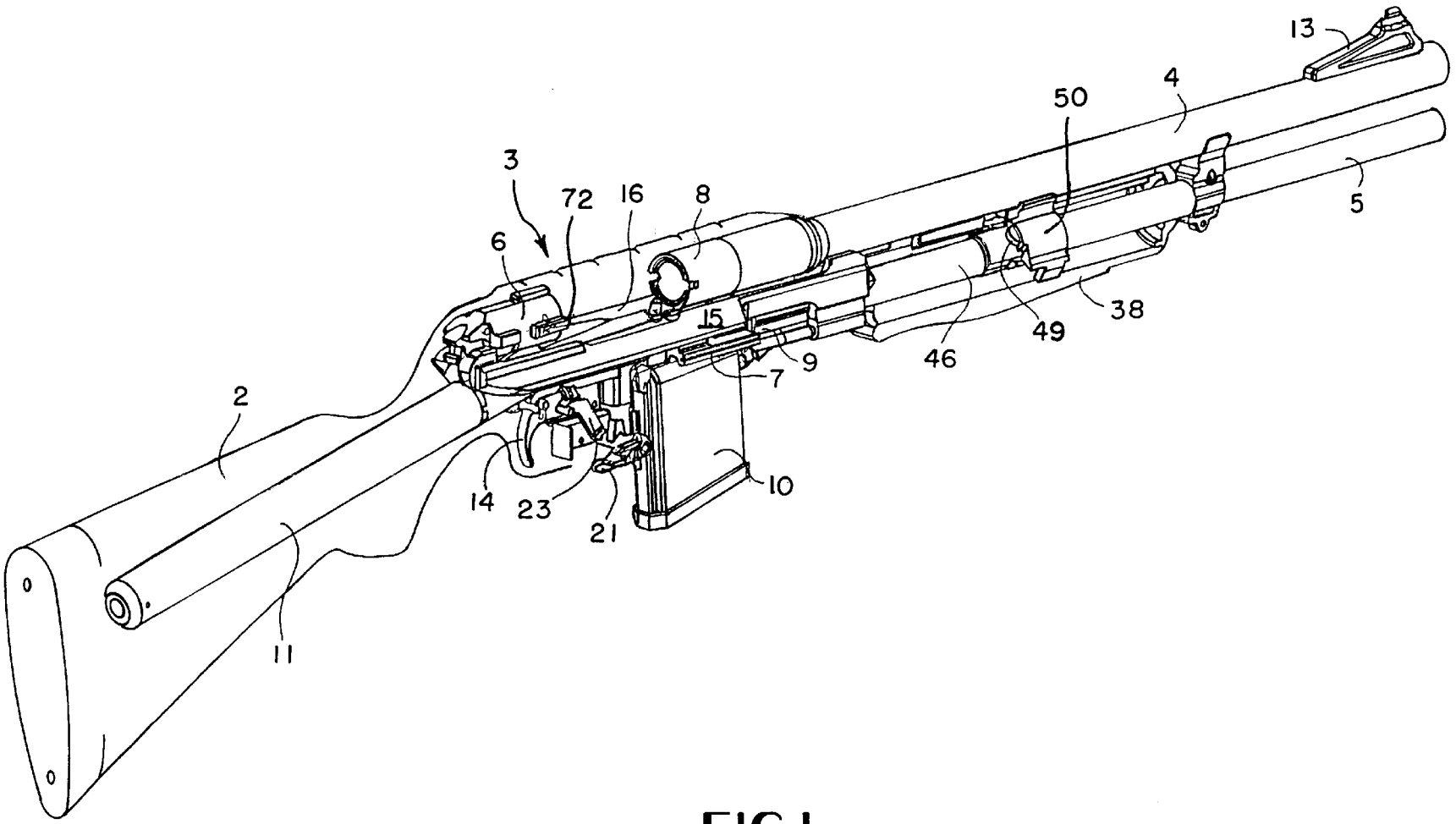
FIG. 1 is a right side oblique view of a multiple-barrel firearm, in accordance with the present invention.

FIG. 1 illustrates a firearm 1 incorporating a breech locking mechanism in accordance with the present invention. The firearm includes a stock 2, a receiver section 3, an upper or first barrel 4, and a lower or second barrel 5. The receiver section 3 includes an upper or first bolt 6 and a lower or second bolt 7. The upper bolt 6 is adapted to reciprocally mate with an upper or first chamber 8 of the upper barrel 4. Whereas, the lower bolt 7 is adapted to reciprocally mate with a lower or second chamber 9 of the lower barrel 5.

The firearm 1 includes a box-type magazine 10 for supplying rifle cartridges to the lower chamber 9, and a tube-type magazine 11 for supplying shotgun shells to the upper chamber 8. Although, one box-type magazine and one tube-type magazine have been illustrated, it should be clear that other combinations of magazines would be adaptable to the present invention. Further, although the upper chamber 8 is adapted to receive shotgun shells and the lower chamber 9 is adapted to receive rifle cartridges, it should be clear that both chambers could receive rifle cartridges, or both chambers is could receive shotgun shells.

The firearm 1 also includes a front sight 13 attached to an upper remote end of the upper barrel 4. A fixed or adjustable rear sight could, of course, be mounted to the upper portion of the receiver section 3. Alternatively, the upper portion of the receiver section 3 could be provided with rails to accommodate the mounting of a scope. The receiver section 3 also includes a selector lever 21 for selecting which barrel of the firearm to fire, and a trigger 14 for firing ammunition from the selected barrel. A forearm 38 is located beneath the lower barrel 5, and is used to discharge spent ammunition from the chamber of the selected barrel, as well as, to charge new ammunition into the chamber of the selected barrel.

Figure 2:
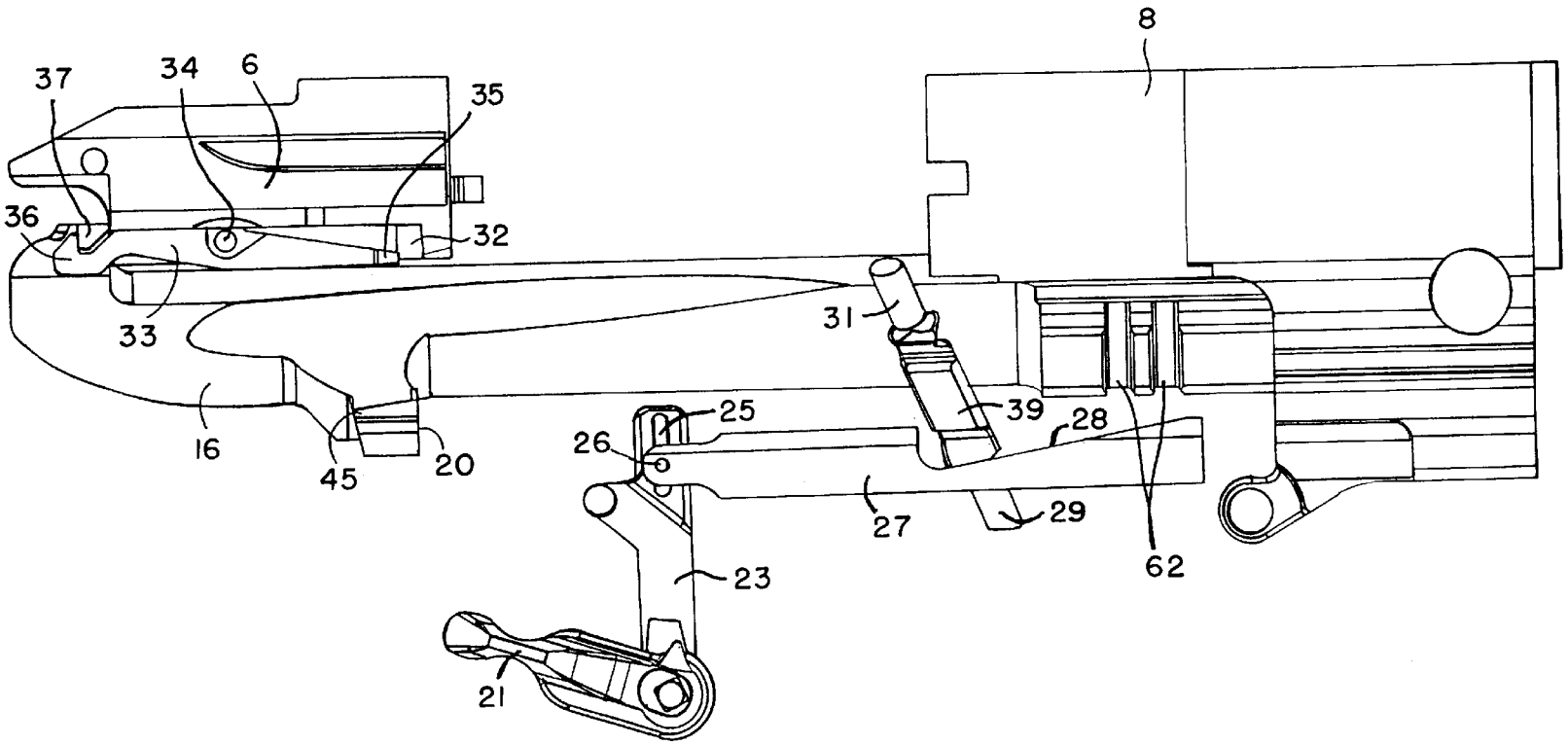
FIG. 2 is a right side view illustrating an upper bolt in a retracted and activated condition, with a right action bar being omitted to allow viewing of the structural components.
Figure 3:
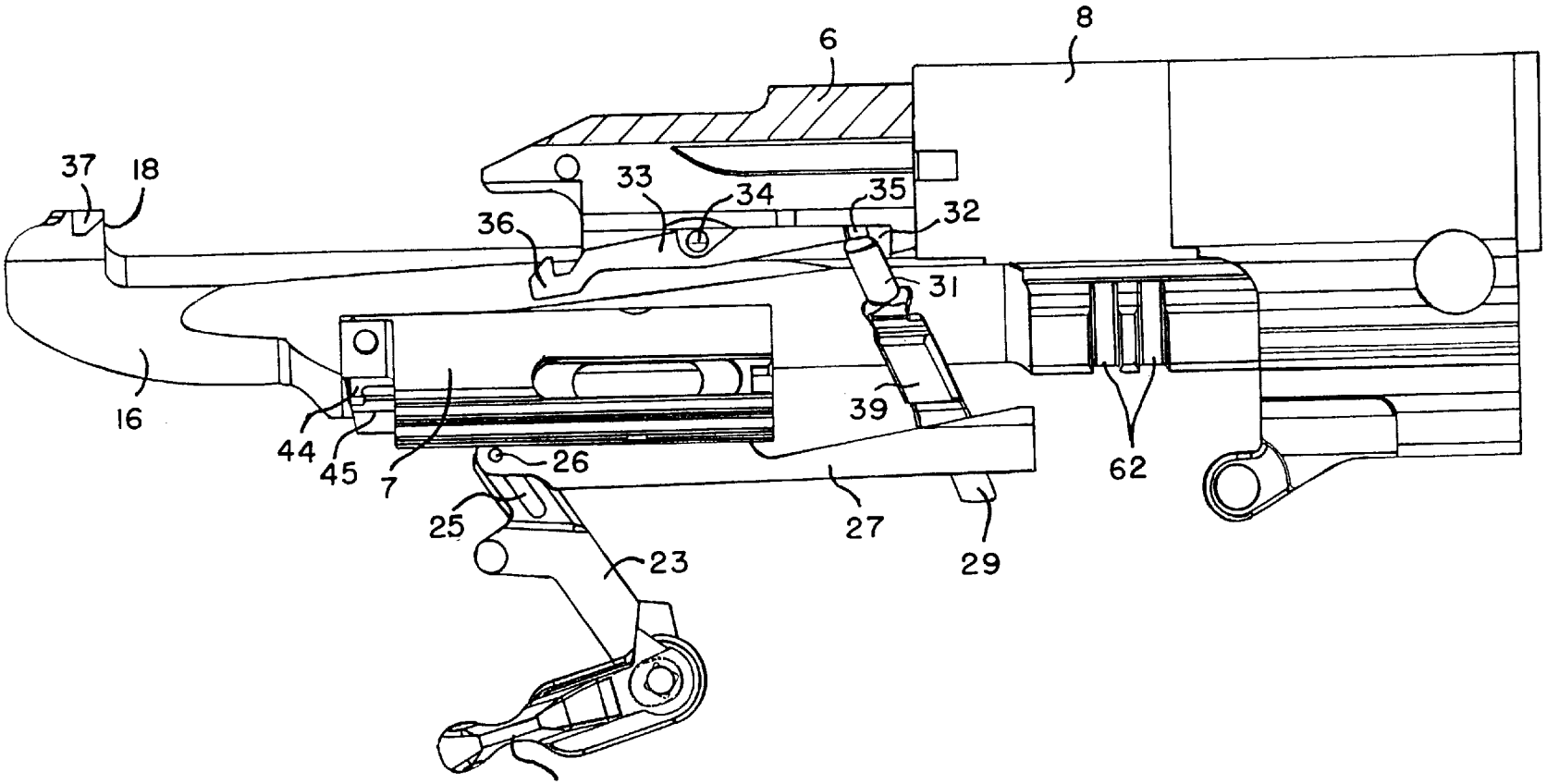
FIG. 3 is a right side view illustrating the upper bolt in a closed and inactive condition, and a lower bolt in a retracted and activated condition, with the right action bar being omitted and the upper bolt being illustrated in cross-section.
Figure 4:
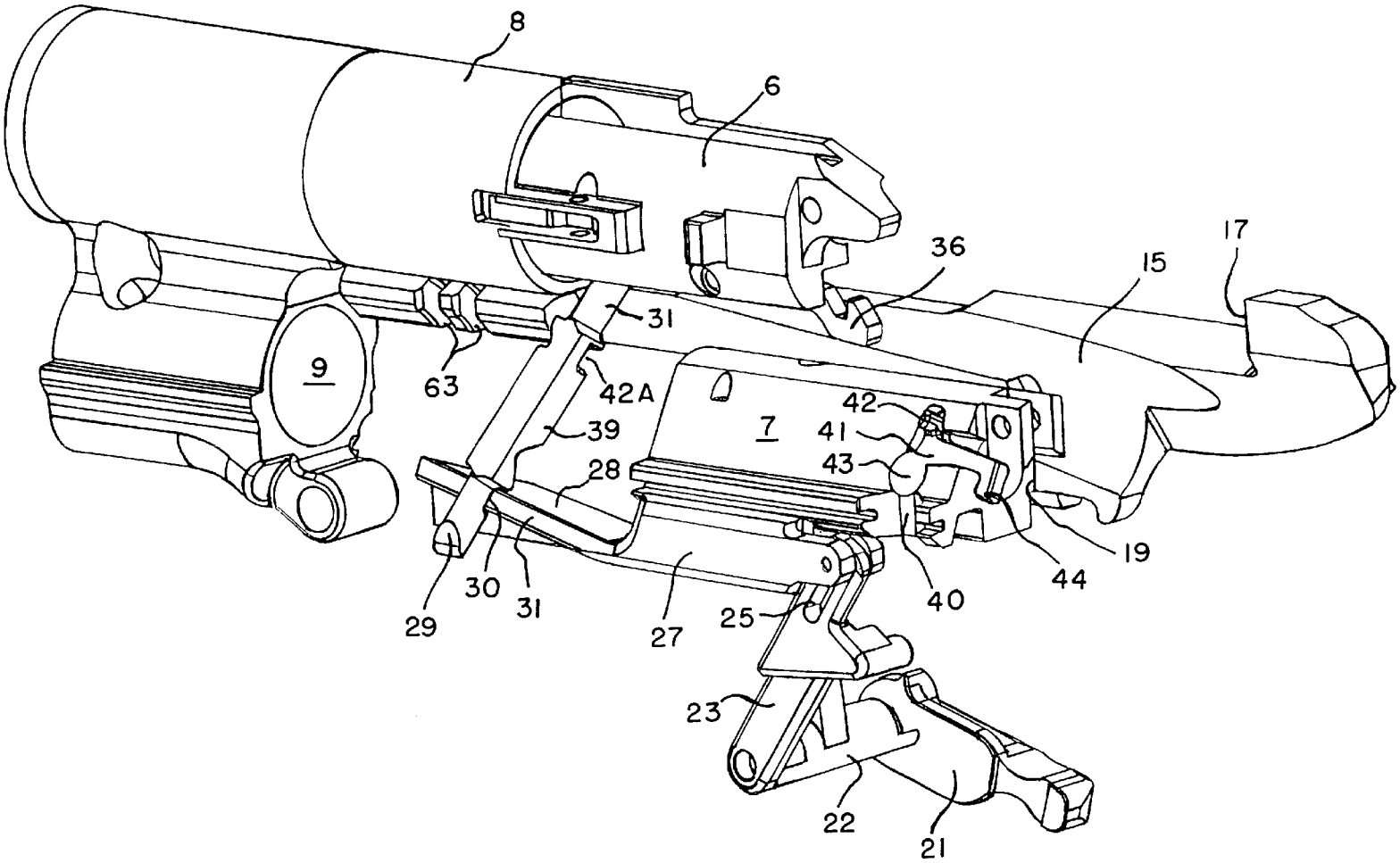
FIG. 4 is a left side oblique view illustrating the upper bolt in the closed and inactive condition, and the lower bolt in a retracted and activated condition, with a left action bar being omitted.

As best illustrated in FIGS. 2–4, the receiver section 3 includes a right action bar 15 and a left action bar 16, mounted for simultaneous, reciprocal movement inside the right and left sides of the receiver section 3. The right and left action bars 15 and 16 include locking surfaces 17 and 18, respectively, for engaging a rear portion of the upper bolt 6. When the right and left action bars 15 and 16 are located in their forward-most position, the locking surfaces 17 and 18 ensure that the upper bolt 6 remains stationary against the upper chamber 8 during firing of ammunition, otherwise known as breech locking the upper barrel 4.

The right and left action bars 15 and 16 also include locking surfaces 19 and 20, respectively, for engaging rear portions of the lower bolt 7. When the action bars 15 and 16 are located in their forward-most position, the locking surfaces 19 and 20 ensure that the lower bolt 7 remains stationary against the lower chamber 9 during firing of ammunition, otherwise known as breech locking the lower barrel 5.

The receiver section 3 also includes a selector assembly. The selector assembly includes the selector lever 21, which is manually accessible and provided on a right side of the receiver section 3. The selector lever 21 is connected to a shaft 22, which extends inside the receiver assembly via a through-hole. Although the selector lever 21 is illustrated on the right side of the receiver section 3, the selector lever could be positioned on the left side of the receiver section 3 to accommodate left handed operators.

Inside the receiver section 3, the shaft 22 is coupled to a selector arm 23. The selector arm 23 is pivotally mounted to the receiver section 3 about the shaft 22. Upon counterclockwise rotation of the selector lever 21, the selector arm 23 is caused to rotate counterclockwise about the shaft 22 (see FIG. 2 in relation to FIG. 3).

The selector arm 23 includes a guide slot 25. The guide slot 25 receives a pin 26 of a selector guide 27. The selector guide 27 is reciprocally mounted in a selector guide channel formed in the receiver section 3. Upon counterclockwise rotation of the selector arm 23 about the shaft 22, the selector guide 27 is slid rearwardly, toward the stock 2 (see FIG. 2 in relation to FIG. 3).

As best seen in FIG. 4, the selector guide 27 includes a selector guide cam surface 28. The selector guide cam surface 28 is formed as a ramping surface. A selector pin 29 includes a selector pin cam slot, or notch, 30 which rides on a side 31 of the selector guide cam surface 28. Linear movement of the selector guide 27 in a forward or rearward direction, causes a linear movement of the selector pin 29. The selector pin 29 moves back and forth in a direction defined by a compound angle (i.e. a direction, which is tilted toward the center of the receiver section 3 and toward the stock 2).

The selector pin 29 serves the function of activating and deactivating the upper bolt 6 and the lower bolt 7. When the selector lever 21 is rotated to its most clockwise position, the selector pin cam slot 30 is located near the bottom of the selector guide cam surface 28, as illustrated in FIG. 2. In this position, the upper bolt 6 is activated and the lower bolt 7 is deactivated. When the selector lever 21 is rotated to its most counterclockwise position, the selector pin cam slot 30 is located near the top of the selector guide cam surface 28, as illustrated in FIG. 3. In this position, the upper bolt 6 is deactivated and the lower bolt 7 is activated. The selector lever 21 may also be located in an intermediate position, between its most clockwise position and its most counterclockwise position. In the intermediate position, both the upper bolt 6 and the lower bolt 7 are deactivated.

The activation and deactivation of the upper bolt 6 will now be discussed with reference to FIG. 3. The selector pin 29 includes an engaging surface 31 located on an end of the selector pin 29 remote from the end containing the selector pin cam slot 30. The engaging surface 31 is adapted to fit into an upper bolt stop surface, or recess, 32 formed in a lower portion of the upper bolt 6. An upper bolt catch 33 is located inside the upper bolt stop surface 32. The upper bolt catch 33 is rotatably fixed to the upper bolt 6 by a fixing device 34, such as a screw. One end 35 of the upper bolt catch 33 is adapted to engage the engaging surface 31 of the selector pin 29, whereas the other end of the upper bolt catch 33 has an upwardly facing hook 36.

When the selector pin 29 is positioned to deactivate the upper bolt 6 (see FIG. 3), the engaging surface 31 of the selector pin 29 is moved into the upper bolt stop surface 32 and engages the one end 35 of the upper bolt catch 33. In this position, the engaging surface 31 of the selector pin 29 locks the upper bolt 6 against the upper chamber 8, and simultaneously pivots the upper bolt catch 33, so that the upwardly facing hook 36 is lowered. Lowering the upwardly facing hook 36 results in a decoupling of the upper bolt 6 from an upper bolt engagement 37 of the left action bar 16, hence placing the upper bolt 6 in the deactivated state. In the deactivated state, the upper bolt 6 will not move rearwardly upon rearward movement of the right and left action bars 15 and 16, but will remain adjacent to the upper chamber 8 due to the presence of the engaging surface 31 inside the upper bolt stop surface 32.

The activated state of the upper bolt 6 occurs when the engaging surface 31 of the selector pin 29 is removed from the upper bolt stop surface 32. When the engaging surface 31 is removed, the upper bolt catch 33 rotates about the fixing device 34 so that the upwardly facing hook 36 couples with the upper bolt engagement 37 of the left action bar 16. In the active state, the upper bolt 6 will move rearwardly to open the upper chamber 8 upon rearward movement of the right and left action bars 15 and 16.

The deactivation of the lower bolt 7 will now be discussed with reference to FIG. 4. The selector pin 29 includes an intermediate surface 39. The intermediate surface 39 is adapted to fit into a lower bolt stop surface, or recess, 40 formed in a side portion of the lower bolt 7. A lower bolt catch 41 is located inside the lower bolt stop surface 40. The lower bolt catch 41 is rotatable inside the stop surface 40 about a hub 43. One end 42 of the lower bolt catch 41 is adapted to engage within a slot 42A of the selector pin 29, whereas the other end of the lower bolt catch 41 has an downwardly facing hook 44.

When the selector pin 29 is positioned to deactivate the lower bolt 7, the intermediate surface 39 of the selector pin 29 is moved into the lower bolt stop surface 40 and the slot 42A engages the one end 42 of the lower bolt catch 41. In this position, the intermediate surface 39 of the selector pin 29 locks the lower bolt 7 against the lower chamber 9, and the slot 42A simultaneously pivots the lower bolt catch 41, so that the downwardly facing hook 44 is raised. Raising the downwardly facing hook 44 results in a decoupling of the lower bolt 7 from a lower bolt engagement 45 of the left action bar 16, hence placing the lower bolt 7 in its deactivated state. In the deactivated state, the lower bolt 7 will not move rearwardly upon rearward movement of the right and left action bars 15 and 16, but will remain adjacent to the lower chamber 9 due to the presence of the intermediate surface 39 inside the lower bolt stop surface 40.

The activated state of the lower bolt 7 occurs when the intermediate surface 39 of the selector pin 29 is removed from the lower bolt stop surface 40. When the intermediate surface 39 is removed, the lower bolt catch 41 rotates about the hub 43, so that the downwardly facing hook 44 couples with the lower bolt engagement 45 of the left action bar 16. In the active state, the lower bolt 7 will move rearwardly to open the lower chamber 9 upon rearward movement of the right and left action bars 15 and 16.

As discussed above, a first function of the right and left action bars 15 and 16 is to lock the upper and lower bolts 6 and 7 to their respective upper and lower chambers 8 and 9 during firing of ammunition. Also, as discussed above, a second function of the right and left action bars 15 and 16 is to move either the upper bolt 6 or the lower bolt 7 to a retracted position, dependent upon the positioning of the selector lever 21.

Now, reference will be made to FIGS. 5–8 to explain the how the right and left action bars 15 and 16 achieve the first function of locking the upper and lower bolts 6 and 7, and the second function of moving the upper and lower bolts 6 and 7.

Inside the forearm 38 is a rotating lug type, locking mechanism. Reciprocating the forearm 38 forwardly and rearwardly causes the rotating lug type, locking mechanism to lock and unlock the right and left action bars 15 and 16, and thus the upper and lower bolts 6 and 7. The rotating lug type, locking mechanism includes a lock sleeve 46, which encircles the lower barrel 5. The lock sleeve 46 is rotatable about the lower barrel 5. One end of the lock sleeve 46 includes two lugs 47 rigidly fixed thereto. The two lugs 47 can engage within two slots 62 formed in both the right and left action bars 15 and 16. The other end of the lock sleeve 46 includes a cap 48 rigidly fixed thereto. The cap 48 has a roller 49 fixed on its side (see FIG. 7). The roller is rotatably attached to the cap 48.

Figure 8:
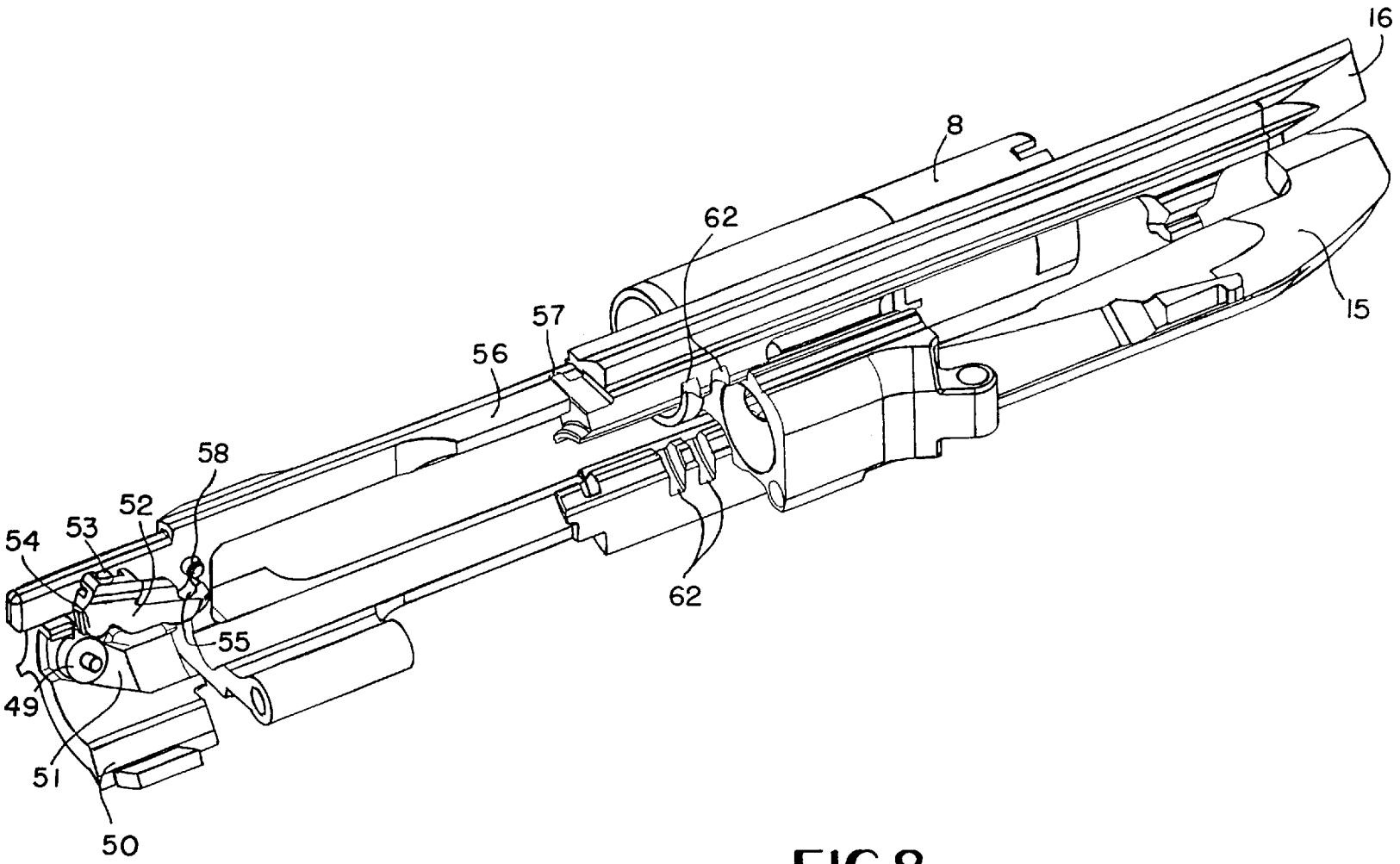
FIG. 8 is a bottom oblique view illustrating components of a cam of the breech locking mechanism.

FIG. 8 illustrates an inside area of the forearm 38, with the lock sleeve 46 removed therefrom, but the roller 49 of the lock sleeve 46 included for explanation. The forearm 38 includes a collar 50 rigidly attached to the inside area of the forearm 38, such that the collar 50 moves in unison with the forearm 38. The collar 50 includes a collar slot 51 recessed into the inside of the collar 50. The collar slot 51 is dimensioned to allow the roller 49 to travel inside the collar slot 51. The collar slot 51 angles, or snakes, along the inside of the collar 50. A latch 52 is positioned adjacent to the collar slot 51. The latch 52 is pivotally mounted to the collar 50 about an axis 53. One end of the latch 52 includes a release protrusion 54. The other end of the latch 52 includes a latch hook 55. The forearm 38 also houses an action bar guide 56. The action bar guide 56 is not connected to the forearm, but is fixed to the right and left action bars 15 and 16 at connection points 57. The action bar guide 56 includes a catch pin 58, which can be coupled to the collar 50, as will be described in greater detail below.

Because the roller 49 is fixed to the lock sleeve 46, movement of the collar 50 will cause the lock sleeve 46 to rotate about the lower barrel 5, as the roller 49 follows the path of the collar slot 51. This rotation of the lock sleeve 46 enables insertion or removal of the two lugs 47 into or from the two grooves 62, depending upon the direction of the movement of the collar 50. Further, as the roller 49 passes the latch 52, the roller 49 contacts the release protrusion 54 causing the latch 52 to pivot about the axis 53.

Figure 5:
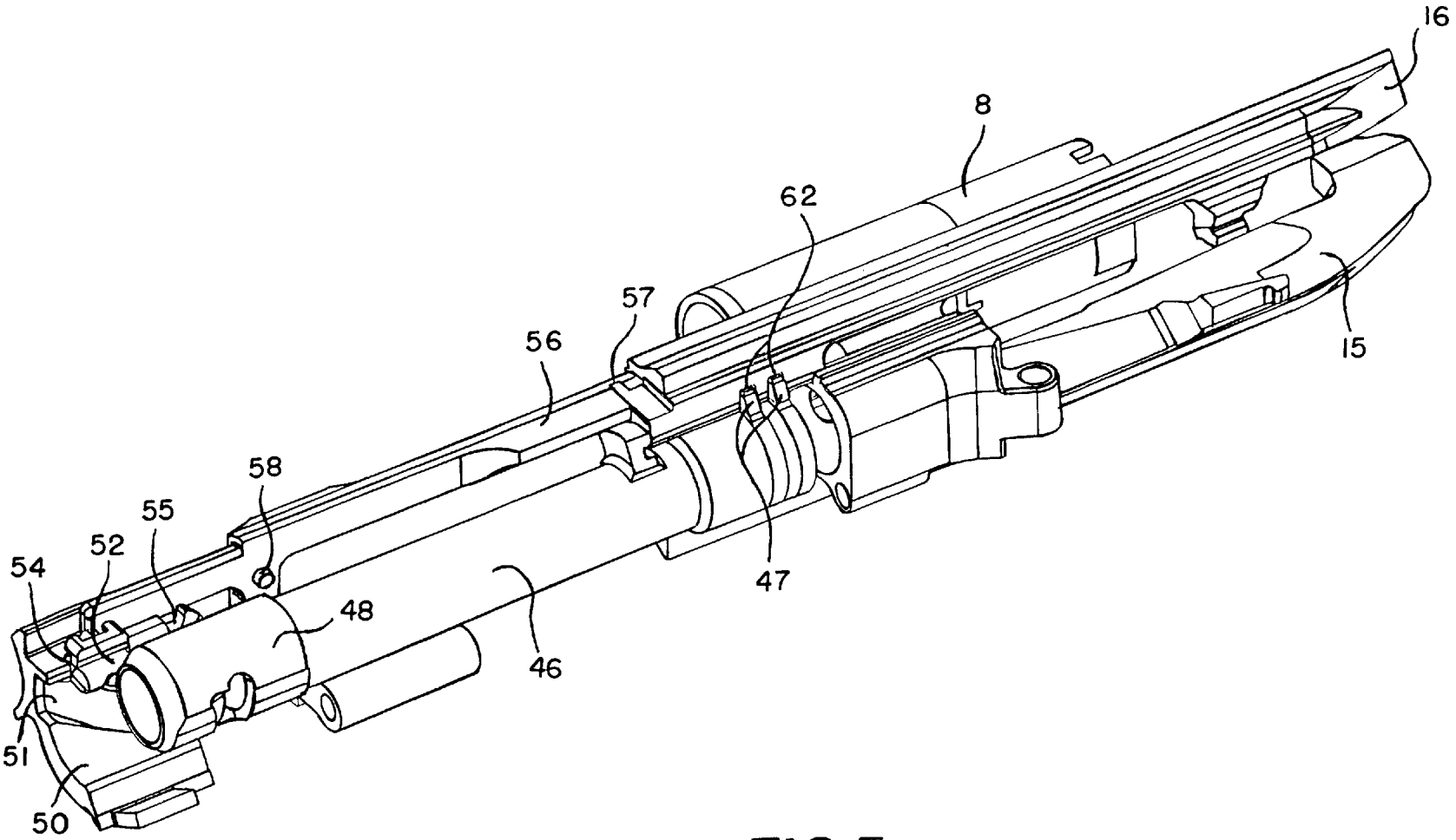
FIG. 5 is a bottom oblique view illustrating a breech locking mechanism in a locked state.

Now, the sequence of operation of the breech-locking mechanism will be explained. FIG. 5 illustrates the condition of the firearm when the forearm 38 is located in its fully forward position. In this position, the two lugs 47 are engaged in the two slots 62 of the right and left action bars 15 and 16, and therefore the upper and lower bolts 6 and 7 are locked adjacent to the upper and lower chambers 8 and 9.

Figure 6:
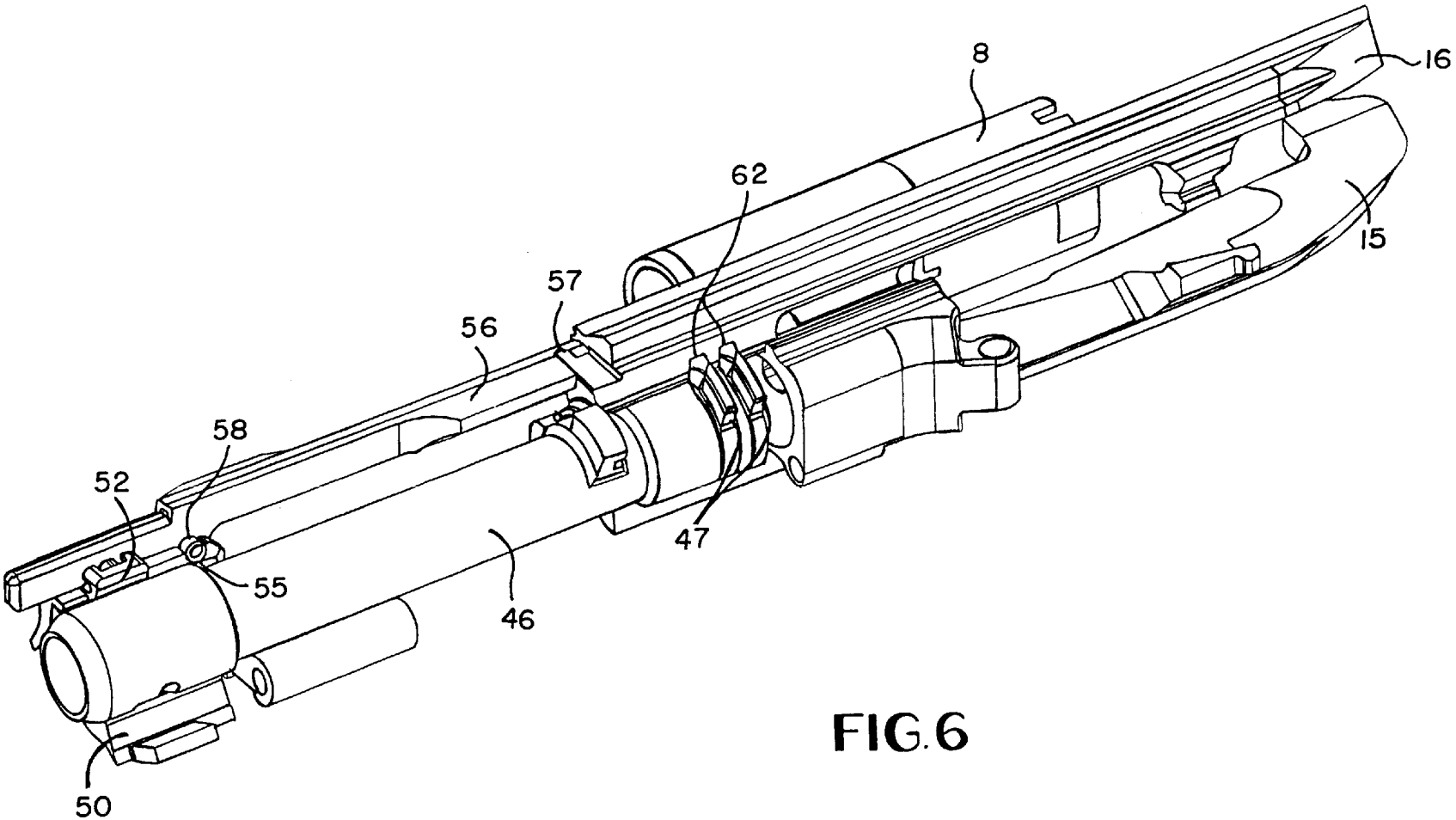
FIG. 6 is a bottom oblique view illustrating the breech locking mechanism, as the breeches are being unlocked.

FIG. 6 illustrates a condition of the locking mechanism as the forearm 38 is retracted toward the stock 2. The collar 50 is moved in unison with the forearm 38, therefore the lock sleeve 46 is rotated to release the two lugs 47 from the two grooves 62. Once the two lugs 47 are released from the grooves 62, the collar 50 will have reached a reward position wherein the latch hook 55 engages and locks onto the catch pin 58 fixed to the action bar guide 56.

Figure 7:
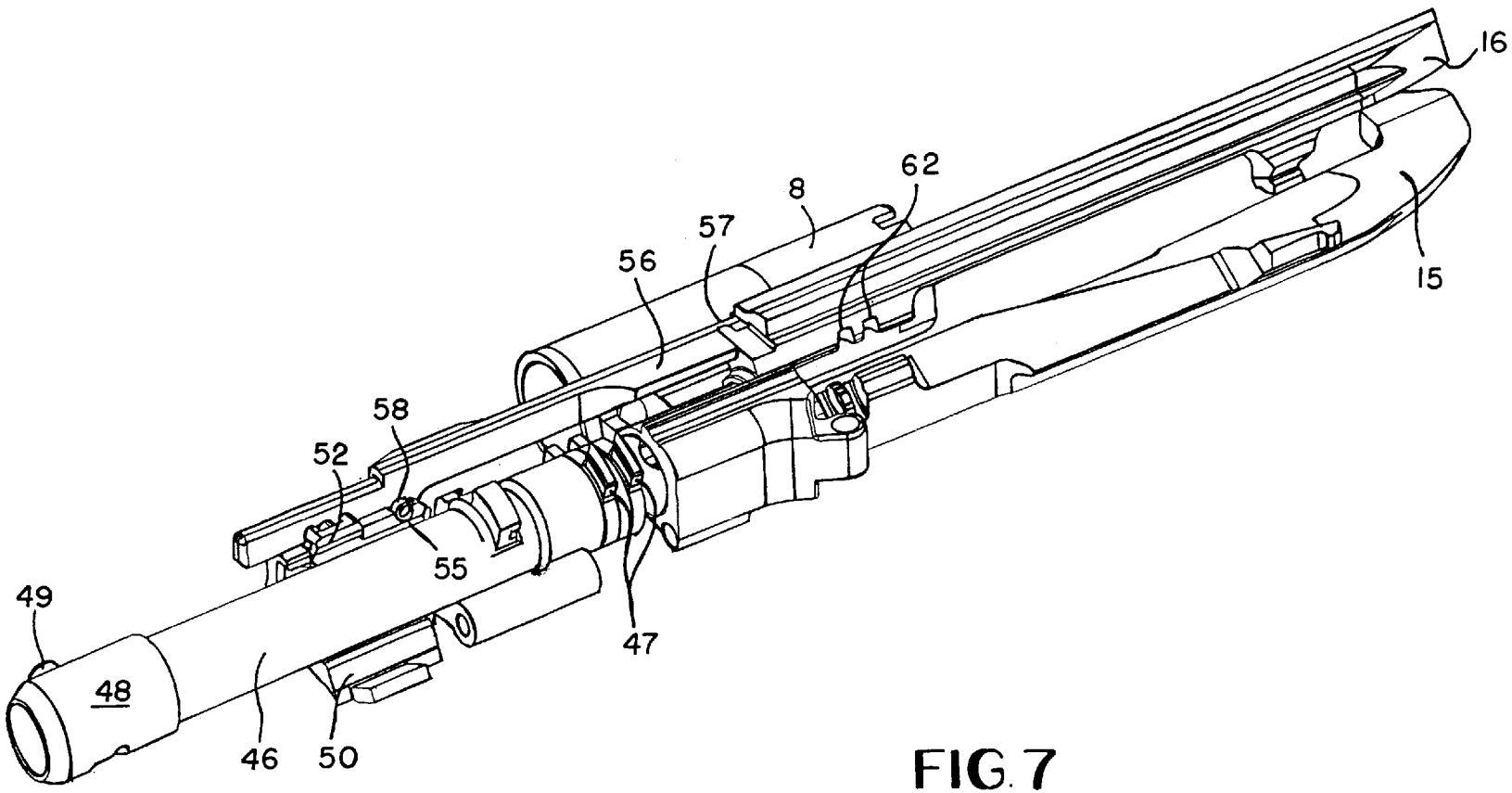
FIG. 7 is a bottom oblique view illustrating a position of the breech locking mechanism as the breeches are being opened.

As illustrated in FIG. 7, further rearward movement of the forearm 38 results in the collar 50 pushing the action bar guide 56 rearwardly due to the engagement of the latch hook 55 with the catch pin 58. The rearward movement of the action bar guide 56 translates into rearward movement of the right and left action bars 15 and 16, due to the rigid attachments at connection points 57. As the right and left action bars 15 and 16 move rearwardly, the upper bolt 6 will be retracted from the upper chamber 7, if the upper bolt 6 is in its active state, as discussed above. Alternatively, the lower bolt 7 will be retracted from the lower chamber 9, if the lower bolt 7 is in its active state.

As the selected bolt is moved to the retracted position, an extractor will eject a spent cartridge inside the selected bolt's chamber. FIG. 1 illustrates an upper extractor 72 for the upper chamber 8. While a bolt is in its retracted position, new ammunition can be mechanically fed into the opened and emptied chamber associated with the retracted bolt.

When the operator begins to the move the forearm 38 toward the front sight 13, the right and left action bars 15 and 16 bring the retracted bolt back toward its chamber. Once the retracted bolt is seated against its chamber, further movement of the forearm 38 causes the lock sleeve 46 to rotate about the lower barrel 5. The two lugs 47 are moved into engagement with the two grooves 62. Simultaneous with the rotation of the lock sleeve 46, the roller 49 contacts the release protrusion 54 of the latch 52. This contact causes the latch 52 to pivot about the axis 53, resulting in the latch hook 55 releasing the catch pin 58. And once again, both the upper bolt 6 and lower bolt 7 are locked against the upper chamber 8 and lower chamber 9, respectively.

Although the locking mechanism illustrated is of the rotating lug type, it should be clear that other locking arrangement such as a ball lock-up arrangement could alternatively be employed. Further, FIGS. 5–8 illustrate a manual pump-action for chambering ammunition into the upper chamber 8 or lower chamber 9, however, the forces generated during firing of the weapon may also be used to chamber ammunition into the upper chamber 8 or the lower chamber 9. For instance, an inertia cam action, or a gas piston action, could be utilized to unlock the right and left action bars 15 and 16 and to automatically move the right and left action bars 15 and 16.

Figure 9:
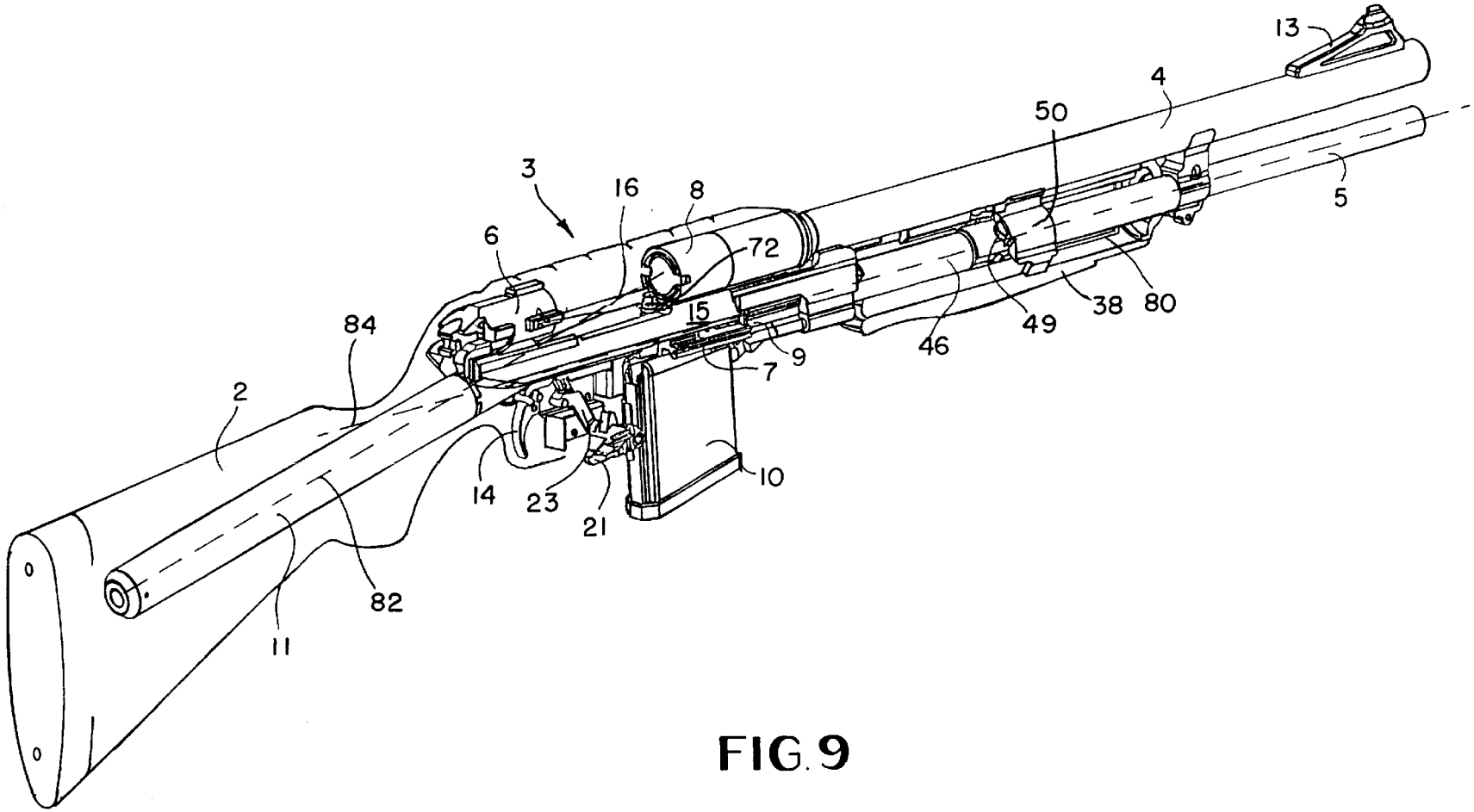
FIG. 9 is right side oblique view of the multiple-barrel firearm, illustrating a gas return tube connecting a lower barrel and the cam of the breech locking mechanism to enable auto-loading of a lower chamber.
Figure 10:
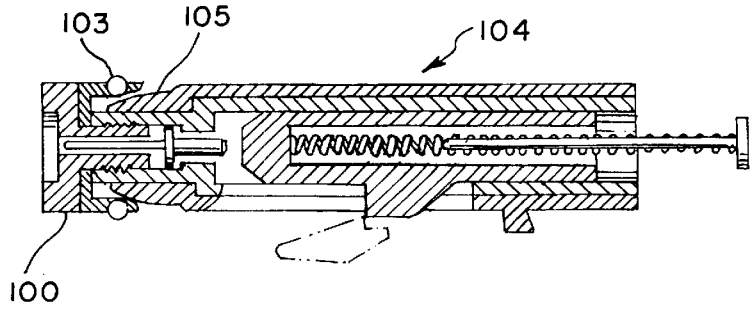
FIG.10 BACKGROUND ART
FIG. 10 is cross-sectional view of a ball lock-up type, breech locking mechanism, in accordance with the background art.
Figure 11:
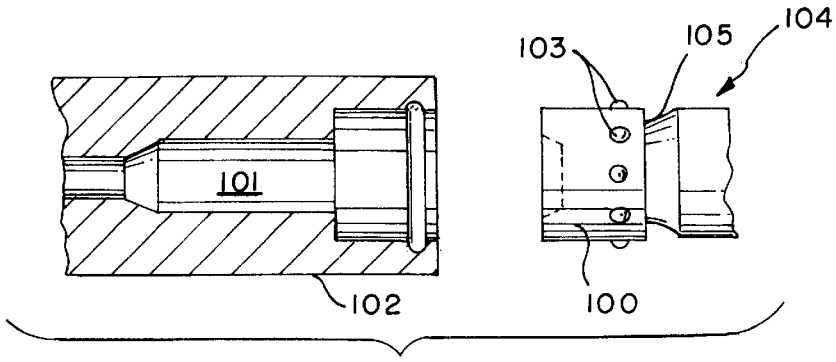
FIG.11 BACKGROUND ART
FIG. 11 is a partial cross-sectional view the ball lock-up type, breech locking mechanism illustrated in FIG. 10.
Figure 12:
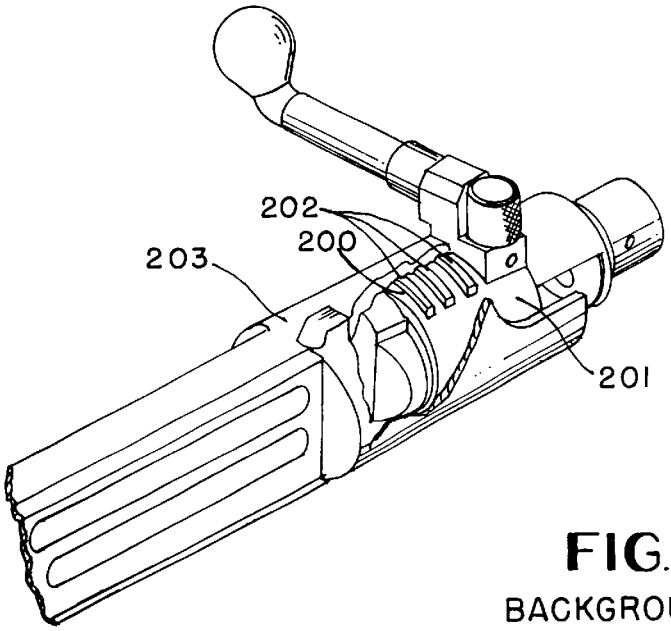
FIG.12 BACKGROUND ART
FIG. 12 is left side oblique view of a rotating lug type, breech locking mechanism, in accordance with the background art.

FIG. 9 illustrates a gas tube 80 connecting the lower barrel 5 and the collar 50. Gas pressures generated by the firing of ammuntion through the lower barrel 5 could be harnessed to auto-feed the lower chamber 9. Moreover, a separate gas tube could also be connected between the upper barrel 4 and collar 50 to allow auto-feeding of ammunition into the upper chamber 8. FIG. 9 also illustrates a feed path 82 for ammunition passing from the tube-type magazine 11 into the upper chamber 8. It should be noted that the feed path 82 passes through a centerline 84 of the second barrel 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A firearm comprising:

a stock primarily extending along a first direction and having an end for engaging a shooter's shoulder;

a first barrel extending substantially parallel to the first direction and having a first end and a second end;

a first chamber located at said first end of said first barrel;

a first bolt for abutting said first chamber of said first barrel;

a breech locking mechanism for locking said first bolt into abutment with said first chamber of said first barrel, wherein said breech locking mechanism includes locking components located between said first end of said first barrel and said second end of said first barrel;

a second barrel extending substantially parallel to said first barrel and having a first end and a second end;

a second chamber located at said first end of said second barrel;

a second bolt for abutting said second chamber of said second barrel, wherein said breech locking mechanism also locks said second bolt into abutment with said second chamber of said second barrel;

a first magazine for feeding ammunition to said first chamber, said first magazine forming at least a portion of said stock; and a second magazine for feeding ammunition to said second chamber.

2. The firearm according to claim 1, wherein said locking components include at least one lug adapted to engage into at least one groove.

3. A firearm comprising:

a stock primarily extending along a first direction and having an end for engaging a shooter's shoulder;

a first barrel extending substantially parallel to the first direction and having a first end and a second end;

a second barrel extending substantially parallel to said first barrel and having a first end and a second end;

a first chamber located at said first end of said first barrel;

a second chamber located at said first end of said second barrel;

a first bolt for abutting said first chamber of said first barrel;

a second bolt for abutting said second chamber of said second barrel;

a breech locking mechanism for locking said first bolt into abutment with said first chamber and for locking said second bolt into abutment with said second chamber;

a first magazine for feeding ammunition to said first chamber, said first magazine forming at least a portion of said stock; and a second magazine for feeding ammunition to said second chamber.

4. The firearm according to claim 3, further comprising:

a first feed path connecting said first magazine and said first chamber, wherein a centerline of said second barrel passes through said first feed path.

5. The firearm according to claim 3, wherein said first barrel is located above said second barrel when said firearm is operated, making said firearm an over-under firearm.

6. The firearm according to claim 5, wherein said first magazine is for housing shotgun shells to dispense to said first chamber, and wherein said second magazine is for housing rifle cartridges to dispense to said second chamber.

7. The firearm according to claim 3, further comprising:

a manual activator for moving at least said first bolt to a position remote from said first chamber to allow removal of spent ammunition and to allow reloading of new ammunition.

8. The firearm according to claim 7, wherein said manual activator moves either said first bolt or said second bolt to positions remote from first chamber or said second chamber, respectively, to allow removal of spent ammunition and to allow reloading of new ammunition.

9. The firearm according to claim 8, wherein said manual activator includes a moveable forearm located adjacent said second barrel.

10. The firearm according to claim 3, further comprising:

a selector for mutually exclusively placing either said first bolt into an operational state, or said second bolt into an operational state.

11. The firearm according to claim 10, further comprising:

a trigger capable of activating either said first bolt or said second bolt to fire a round of ammunition, should said first bolt or second bolt be in said operational state, respectively.

12. The firearm according to claim 3, wherein said first magazine is a tube magazine and said second magazine is a box magazine.

13. A firearm comprising:

a stock primarily extending along a first direction and having an end for engaging a shooter's shoulder;

a first barrel extending substantially parallel to the first direction and having a first end and a second end;

a second barrel extending substantially parallel to said first barrel and having a first end and a second end;

a first chamber located at said first end of said first barrel;

a second chamber located at said first end of said second barrel;

a first bolt for abutting said first chamber of said first barrel;

a second bolt for abutting said second chamber of said second barrel;

a breech locking mechanism for locking said first bolt into abutment with said first chamber and for locking said second bolt into abutment with said second chamber;

a first magazine for feeding ammunition to said first chamber, said first magazine feeding ammunition in a second direction which is substantially parallel to the first direction; and a second magazine for feeding ammunition to said second chamber, said second magazine feeding ammunition in a third direction which is substantially perpendicular to the first direction.

14. The firearm according to claim 13, wherein said first magazine forms at least a portion of said stock.

15. The firearm according to claim 13, wherein said first barrel is located above said second barrel when said firearm is operated, making said firearm an over-under firearm, wherein said first magazine is for housing shotgun shells to dispense to said first chamber, and wherein said second magazine is for housing rifle cartridges to dispense to said second chamber.

16. The firearm according to claim 13, further comprising:

a selector for mutually exclusively placing either said first bolt into an operational state, or said second bolt into an operational state; and a trigger capable of activating either said first bolt or said second bolt to fire a round of ammunition, should said first bolt or second bolt be in said operational state, respectively.

17. The firearm according to claim 13, further comprising:

a manual activator for moving either said first bolt or said second bolt to positions remote from said first chamber or said second chamber, respectively, to allow removal of spent ammunition and to allow reloading of new ammunition, wherein said manual activator includes a moveable forearm located adjacent said second barrel.

18. A firearm comprising:

a stock primarily extending along a first direction and having an end for engaging a shooter's shoulder;

a first barrel extending substantially parallel to the first direction and having a first end and a second end;

a second barrel extending substantially parallel to said first barrel and having a first end and a second end;

a first chamber located at said first end of said first barrel;

a second chamber located at said first end of said second barrel;

a first bolt for abutting said first chamber of said first barrel;

a second bolt for abutting said second chamber of said second barrel;

a breech locking mechanism for locking said first bolt into abutment with said first chamber and for locking said second bolt into abutment with said second chamber, wherein said breech locking mechanism includes locking components located between said first end of said first barrel and said second end of said first barrel;

a first magazine for feeding ammunition to said first chamber, said first magazine forming at least a portion of said stock and said first magazine primarily extending in a direction which is substantially parallel to the first direction; and a second magazine for feeding ammunition to said second chamber, said second magazine primarily extending in a direction which is substantially perpendicular to the first direction.

* * * * *